US009068457B2

(12) United States Patent
Jaeschke et al.

(10) Patent No.: US 9,068,457 B2
(45) Date of Patent: Jun. 30, 2015

(54) DOUBLE-FLOW SCREW SPINDLE MACHINE

(75) Inventors: Axel Jaeschke, Minden (DE); Stefan Ladig, Hannover (DE)

(73) Assignee: Joh. Heinr. Bornemann GmbH, Oberkirchen (DE)

( * ) Notice: Subject to any disclaimer, the term of this patent is extended or adjusted under 35 U.S.C. 154(b) by 120 days.

(21) Appl. No.: 13/370,911

(22) Filed: Feb. 10, 2012

(65) Prior Publication Data

US 2012/0207866 A1 Aug. 16, 2012

(30) Foreign Application Priority Data

Feb. 16, 2011 (DE) ..... 10 2011 011 404

(51) Int. Cl.

| | |
|---|---|
| ***F04C 2/00*** | (2006.01) |
| ***F01C 1/16*** | (2006.01) |
| ***F01C 11/00*** | (2006.01) |
| ***F01C 21/00*** | (2006.01) |
| ***F01C 21/18*** | (2006.01) |
| ***F04C 13/00*** | (2006.01) |

(52) U.S. Cl.

CPC ..... *F01C 1/16* (2013.01); *F01C 11/002* (2013.01); *F01C 21/007* (2013.01); *F01C 21/18* (2013.01); *F04C 13/007* (2013.01); *F04C 2210/24* (2013.01); *F04C 2220/20* (2013.01); *F04C 2240/102* (2013.01)

(58) Field of Classification Search

USPC ..... 418/201.1, 202, DIG. 1, 9, 97–100, 270; 95/241, 253–254; 96/155, 182–184; 62/196.1, 509, 513; 60/772

See application file for complete search history.

(56) References Cited

U.S. PATENT DOCUMENTS

| | | | | |
|---|---|---|---|---|
| 4,995,797 | A | 2/1991 | Tsuboi | |
| 5,738,505 | A * | 4/1998 | Mezzedimi et al. | 418/102 |
| 5,947,711 | A * | 9/1999 | Myers et al. | 418/85 |
| 6,478,560 | B1 * | 11/2002 | Bowman | 418/199 |
| 6,962,056 | B2 * | 11/2005 | Brasz et al. | 60/772 |
| 8,197,700 | B2 * | 6/2012 | Beyk | 95/253 |
| 8,561,425 | B2 * | 10/2013 | Mitra et al. | 62/498 |
| 8,671,703 | B2 * | 3/2014 | Mitra et al. | 62/196.1 |
| 2011/0135528 | A1 | 6/2011 | Amano | |

FOREIGN PATENT DOCUMENTS

| | | |
|---|---|---|
| EP | 0 183 380 | 6/1986 |
| GB | 2 227 057 | 7/1990 |
| WO | 94/27049 | 11/1994 |

OTHER PUBLICATIONS

EPO, "European Search Report", Jul. 16, 2014, pp. 1-6.

* cited by examiner

*Primary Examiner* — Thomas Denion
*Assistant Examiner* — Thomas Olszewski
(74) *Attorney, Agent, or Firm* — Whitham Curtis Christofferson & Cook, PC

(57) ABSTRACT

The invention relates to a double-flow screw spindle machine for drive generation by multiphase mixtures or for the delivery of multiphase mixtures, comprising at least two separate inlet chambers (11, 12) and an outlet chamber (20), and a separator (30), situated upstream of the inlet chambers (11, 12), for separating liquid phase and gas phase. The object of the present invention is to provide a dual-flow screw spindle machine which is easily adaptable to changed process conditions. This object is achieved by virtue of the fact that both inlet chambers (11, 12) are connected to the separator (30) by separate lines (31, 32; 33) for the gas phase and the liquid phase.

9 Claims, 2 Drawing Sheets

DOUBLE-FLOW SCREW SPINDLE MACHINE

FIELD OF THE INVENTION

The invention relates to a double-flow screw spindle machine for drive generation by multiphase mixtures or for the delivery of multiphase mixtures, comprising at least two separate inlet chambers and an outlet chamber, as well as a separator, situated upstream of the inlet chambers, for separating liquid phase and gas phase.

BACKGROUND

WO 94/27049 A1 describes a double-flow multiphase screw spindle machine for the delivery of a multiphase mixture. As the feed elements, two contactlessly intermeshing, contrarotating feed screw pairs are provided, respectively comprising a right-hand feed screw and a left-hand feed screw. The interlocking feed screws form, together with the housing enclosing them, individually closed-off feed chambers. Upon rotation via a drive shaft, these chambers move continuously and parallel to the shafts from the suction side to the pressure side. The suction side is here arranged centrically, with the pressure chamber surrounding the feed spindles. In the pressure chamber, devices for separating the respective liquid phase from the gas phase of the medium flow leaving the feed screw are provided. A part-quantity of the separated liquid phase is led back to the suction chamber via a short-circuit line.

EP 183 380 A1 describes a double-flow screw spindle pump having an inlet chamber disposed on the front of the feed screw pairs. The medium to be pumped is moved into convergence by the two feed screw pairs and is discharged from a centrally disposed outlet. A similarly constructed screw spindle pump is known from GB 2,227,057 A1. Condensers for vaporized fluid are provided within the housing in order to provide an adequate liquid supply.

U.S. Pat. No. 4,995,797 describes a single-flow screw spindle pump having a pressure-controlled return flow of a separated liquid component. The separator is disposed on the pressure side of the pump.

SUMMARY

In a double-flow multiphase screw spindle motor, the multiphase fluid is conducted through the screw spindles. The fluid flows in the inlet chambers must have a minimum liquid component in order to seal the gaps between the screw spindles and the housing. The inlet pressure in the inlet chambers is higher than the outlet pressure. The hydraulic energy is converted into mechanical energy, for example in order to drive a generator.

The object of the present invention is to provide a dual-flow screw spindle machine which is easily adaptable to changed process conditions.

According to the invention, this object is achieved by a dual-flow screw spindle machine having the features of the main claim. Advantageous embodiments and refinements of the invention are described in the subclaims.

The inventive dual-flow screw spindle machine for drive generation by multiphase mixtures or for the delivery of multiphase mixtures, comprising two separate inlet chambers and an outlet chamber, and a separator, situated upstream of the inlet chambers, for separating liquid phase and gas phase provides that both inlet chambers are connected to the separator by separate lines for the gas phase and the liquid phase. As a result of the separate feed of the separated gas phase and separated liquid phase to the two inlet chambers, it is possible to enable a precise control of the liquid supply to the screw spindles. The liquid phase serves to seal the gaps between the screw spindles and between the screw spindles and the housing. The supply of liquid to the screw spindles can thus be realized directly and requires no admixture to the gas phase.

A switching device for interrupting the liquid supply to an inlet chamber can be provided, so that, given high gas phases and a low fill level in the separator, only one feed screw pair is supplied with liquid, so that, during operation as a hydraulic motor, this runs on at reduced power and, during operation as a feed pump, a reduced pumping capacity is provided.

Outlets for connecting lines from the separator to the inlet chambers for the liquid phase can be arranged at different levels in the separator, so that automatically, should a liquid component in the feed flow or in the separator fall below a certain level, namely beneath the level of the upper outlets, only the liquid phase is fed through the outlet at the lower level, so that the liquid phase is automatically conducted into one of the inlet chambers only via this connecting line.

A switching valve can be disposed in or on a connecting line or in or on the separator, so that the supply of liquid phase to the screw spindle can be controlled via the switching valve.

A storage chamber and a surge chamber, which are fluidically connected to each other, can be formed in the separator. The multiphase mixtures makes its way into the surge chamber directly from a pipeline, for example from a feed pipe of a hydrocarbon source. In the surge chamber, a first separation of liquid phase and gas phase takes place. From the surge chamber, the liquid phase and the gas phase make their way into a storage chamber, which serves to ensure that an adequate supply of liquid is present on the inlet side of the screw spindle machine. In the storage chamber, the liquid phase, due to the different densities, is deposited on the base, while the gas phase of the multiphase mixture is located above the liquid phase in the separator, in particular in the storage chamber. From the storage chamber, separate lines for the gas phase and the liquid phase then run to the inlet chambers of the screw spindle machine.

A splash wall having a low-situated passage opening can be disposed in the separator, so that the liquid phase already deposited in the surge chamber can flow through the passage opening into the storage chamber. In addition to the low-situated passage opening, further openings can also be present in the splash wall in order to conduct the gas phase from the surge chamber to the storage chamber, for example.

A blocking device can be disposed in or on a connecting line for the gas phase from the separator to an inlet chamber, so that separately or in addition to a blocking of the liquid phase, the gas phase, at least to one inlet chamber, can also be blocked. One complete side of the screw spindle machine can thereby be decoupled from the feed flow, so that the machine can be operated only at half power.

The machine is configured either as a motor or as a pump.

BRIEF DESCRIPTION OF THE DRAWINGS

Illustrative embodiments of the invention are explained in greater detail below with reference to the appended figures. The same reference symbols denote the same structural elements.

DETAILED DESCRIPTION

Figure 1:
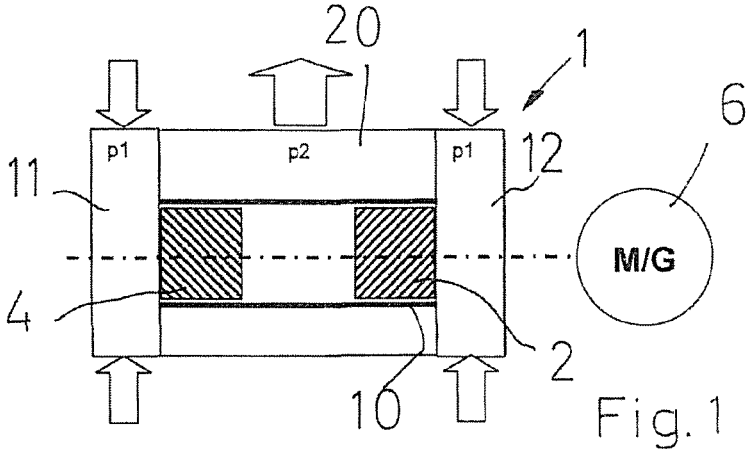
FIG. 1—shows a schematic representation of a screw spindle machine as a motor.

In FIG. 1, a screw spindle machine 1 in the form of a dual-flow multiphase screw spindle motor is shown in a schematic representation. The screw spindle machine has two separate inlet chambers 11, 12, via which screw spindle pairs, of which only two screw spindles 2, 4 are shown in FIG. 1, are supplied with a multiphase mixture. In the embodiment as a motor, the inlet pressure p1 is greater than the outlet pressure p2 abutting on an outlet chamber 20, so that, as a result of the differential pressure, no liquid can be fed back onto the inlet side. The spindles 2, 4 drive a generator 6; should the machine be run in pump operation, the spindles 2, 4 are coupled to a motor.

For the sealing of the gaps between the feed screws 2, 4 and between the feed screws 2, 4 and a housing wall enclosing the feed screw pairs, a minimal liquid component of the feed medium is necessary. In motor operation, the component can, for example, be greater than 30% of the total feed volume. Owing to the occurring variations in the phase composition in multiphase mixtures, i.e. given a fluctuating liquid phase and gas phase percentage between 100% liquid component and 100% gas component, a liquid supply must be provided on the inlet side in the pipeline in front of the screw spindle machine. A liquid supply is provided in the form of an upstream separator having a storage chamber. The pipeline leads directly into the separator, without the fluid having previously passed through the screw spindle machine.

Figure 2:
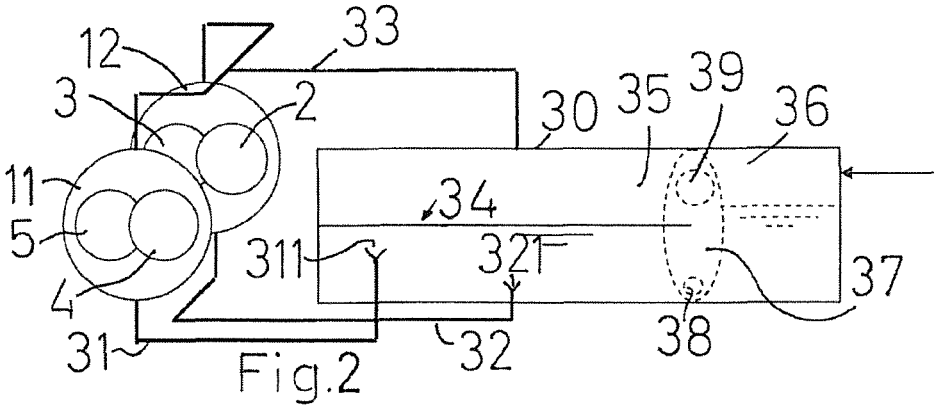
FIG. 2—shows a schematic representation of the screw spindle machine given a first liquid level.

A schematic representation of such a construction is represented in FIG. 2. The screw spindle pairs 2, 3 and 4, 5 are represented schematically, as are the two separate inlet chambers 11, 12, which on the inlet side cooperate with the screw spindle pairs 2, 3, 4, 5. Mounted upstream of the inlet chambers 11, 12 and the screw spindle pairs 2, 3, 4, 5 is a separator 30, which is coupled to the inlet chambers 11, 12 via connecting lines 31, 32, 33. The separator 30 has a surge chamber and a storage chamber 35. The multiphase mixture makes its way into the surge chamber 36 from a pipeline, for example a feed line, as is indicated by the right-hand arrow. The surge chamber 36 is separated from the storage chamber 35 by a splash wall 37. In the splash wall 37 is disposed a low-situated passage opening 38 in the form of a bore or a cutout. Through the low-situated passage opening 38, the liquid phase deposited on the base of the separator 30 makes its way into the storage chamber 35. An upper through opening is likewise provided in the splash wall 37. The upper through opening 39 has a larger flow area than the low-situated passage opening 38 and serves primarily for the passage of the gas phase. In the event of a high liquid component in the supplied multiphase flow, the liquid phase also makes its way through the upper through opening 39.

An upper connecting line 33 serves for the supply of the gas phase from the separator 30 to the respective inlet chambers 11, 12. The connecting line 33 has a branching, so that both inlet chambers 11, 12 are subjected to the same gas pressure. The two inlet chambers 11, 12 of the screw spindle machine are thus connected on the gas side via the separator 30, so that the inlet pressure is equal on both sides and a hydraulic pressure equalization of the screw spindle pairs 2, 3, 4, 5, i.e. of the rotors, remains assured.

On the bottom side, the connecting lines 31, 32 for the liquid phase are disposed on the separator 30. In the represented illustrative embodiment, two separate connecting lines 31, 32, which effect a separate feed of the liquid phase to the inlet chambers 11, 12, are provided. The connecting lines 31, 32 project into the separator 30, and there into the storage chamber 35, wherein the outlets 311, 321, i.e. the openings of the connecting lines 31, 32 into the storage chamber 35, are located at different levels, i.e. in different height positions. In the represented illustrative embodiment, the connecting line 31 having the outlet 311 is disposed at a higher level than the connecting line 32 having the outlet 321. This arrangement at different levels serves as a switching device, which interrupts the liquid supply to one inlet chamber 11 as soon as the liquid level in the storage chamber 35 falls beneath the level of the outlet 311 of one connecting line 31.

The fill level 34 of the liquid phase in the storage chamber 35 of the separator 30 communicates with the fill level of the inlet chambers 11, 12 at the screw spindle inlets of the screw spindle machine, in particular if the separator 30 is located at the same level as the inlet chambers 11, 12. The feed screw pairs 2, 3, 4, 5 receive the necessary liquid quantity directly from a liquid sump in the storage chamber 35. If need be, a metering device can be provided within the liquid sump or in one of the connecting lines 31, 32. Insofar as no metering device is present, the feed screw chambers are filled with a greater or lesser amount of liquid according to the fill level of the storage chamber 35.

On the bottom side, at different levels, the liquid is thus drawn from the separator 30, so that no mixing device for the gas phase and the liquid phase is present. In the upper region of the separator 30, the gas phase is fed via the connecting line 33 to the inlet chambers 11, 12 of the screw spindle machines, preferably from above, separately from the liquid phase. By influencing the flow resistances in the connecting lines 31, 32, 33, for example by control fittings, it is possible to influence the storage characteristics of the separator 30. In the event of very high liquid components in the feed flow, the liquid phase can also be supplied via the upper connecting line 33, so that liquid quantities which can no longer be supplied through the lower connecting lines 31, 32 can be fed to the screw spindle machine, for example the hydraulic motor or the pump, via the upper connecting line 33.

If the liquid component in the feed flow falls below the liquid quantity necessary for both feed screw pairs 2, 3, 4, 5, i.e. beneath the outlet opening 311 of one connecting line 31, the liquid which is still available is fed to just one feed screw pair 2, 3. Hence it is also possible for just one feed screw pair to perform hydraulic work, while the other feed screw pair 4, 5 acts as a gas throttle and thus automatically draws off the surplus gas component. In the operating mode as a motor, the power output drops, yet a controlled operation with approximately equal rotation speed is maintained.

If the liquid component in the total feed flow and in the storage chamber 35 of the separator 30 falls beneath the level of the lowest outlet 321, which is preferably disposed at the lowest point of the storage chamber 35, then a liquid phase is no longer available to seal the gaps between the feed screw pairs 2, 3, 4, and between the feed screws 2, 3, 4, 5 and the housing 10, so that in motor operation, the screw spindle machine stands idle.

Figure 3:
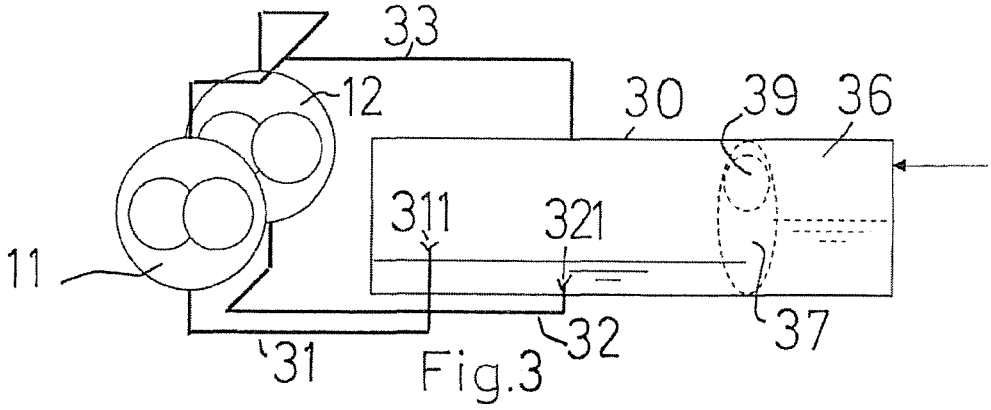
FIG. 3—shows a representation according to FIG. 2 with a lowered liquid level.

In FIG. 3, the situation in which the liquid phase is at a level which lies beneath the upper outlet 311 is shown. Liquid phase is now conducted just through the lower outlet 321 through the connecting line 32 to an inlet chamber 12 and there seals the gaps between the feed screw pairs 2, 3 and between these and the housing 10. The second inlet chamber 11 is not supplied with liquid phase, but only with gas phase from the upper connecting line 33 and the separate connecting line 31 which is actually provided for the liquid phase, so that a sealing of the gap between the feed screw pairs 4, 5 does not take place, with the inlet side serving merely as a gas throttle.

Figure 4:
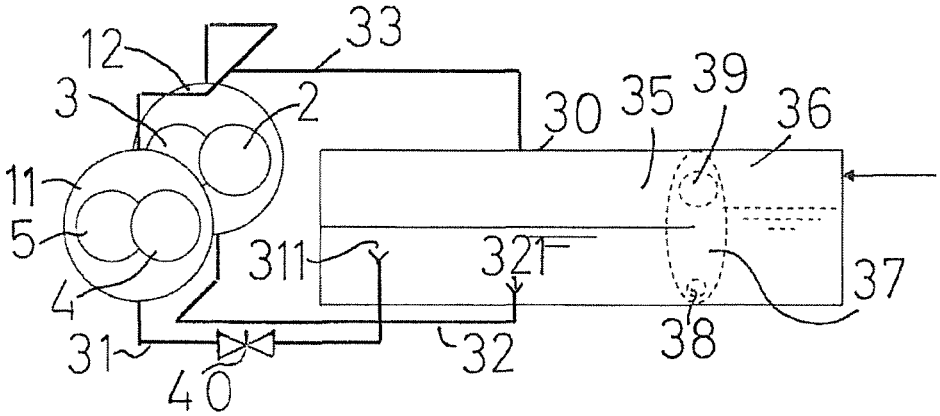
FIG. 4—shows a variant of the embodiment according to FIG. 3 with a switching device.

A variant of the invention is shown in FIG. 4. The outlets 311, 321 are located at an approximately same level, for example in the base of the separator 30. In a connecting line 31, a switching valve 40 is disposed, which closes once a predetermined fill level, detected, for example, by a sensor, is reached, so that only one inlet side is supplied with liquid phase. Switching valves 40 can also be provided in both connecting lines 31, 32 for the liquid phase, which switching valves can be alternately switched over, so that, in the event of a low liquid component and a correspondingly low level within the storage chamber 35, one feed screw pair is operated on an alternating basis without sealing and liquid supply, while the other feed screw pair acts as a gas throttle.

Figure 5:
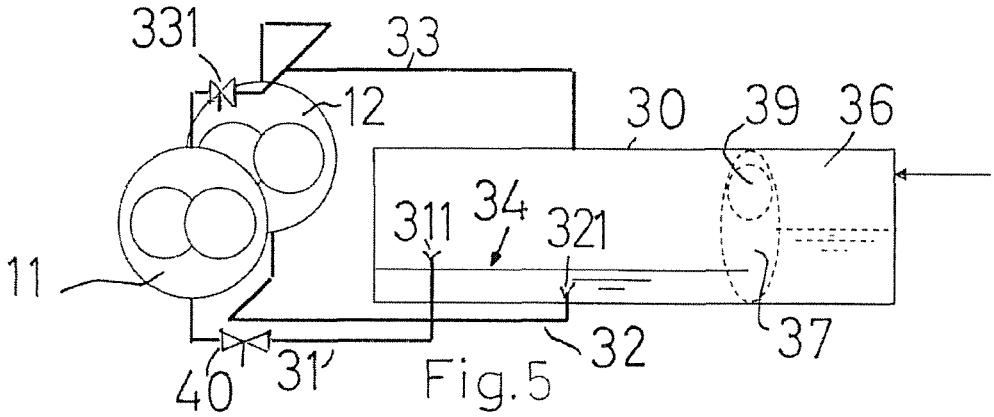
FIG. 5—shows a variant of FIG. 3 with a switching device and a blocking device in a gas line.

A further variant is represented in FIG. 5, in which a blocking device 331 in the form of a switching valve or shut-off valve is disposed within the connecting line 33 for the gas phase. Particularly in conjunction with a switching valve 40 within a connecting line for a liquid phase, such an arrangement can be used to switch from a dual-flow operation to a single-flow operation, so that at least sufficient liquid is present to seal off a screw spindle pair by means of the liquid phase. In principle, it is also possible to furnish both inlet chambers 11, 12 with appropriate blocking devices 331, so that, separately, an inlet chamber 11 can respectively be completely switched off via the blocking device 331 and the switching valve 40. This presumes four shut-off devices in the form of two switching valves 40 and two blocking devices 331. In an arrangement comprising outlets 311, 321 of different height, blocking devices 331 and/or switching valves 40 can likewise be provided.

Apart from use as a motor, the screw spindle machine 1 can also be operated as a pump.

The advantage of an above-described embodiment consists in the separation of the gas phase and liquid phase separation functions and in the generation of the hydraulic power. As a result of an almost freely selectable separation chamber 36 and a storage chamber 35, an adaptation to the respective feed or work process is possible, while there is also the possibility of varying the respective volume of the storage chamber 35 and the surge chamber 36 through an adjustable or displaceable arrangement of the splash wall 37 within the separator 30.

The separator 30 can be of tubular configuration, for example, so that it can be very cheaply produced with a relatively small diameter and a thin wall. No separate devices for injecting liquid phase into the respective inlet chamber 11, 12 are necessary, while the equipment costs for a correct percentage mixture of liquid phase and gas phase are likewise eliminated. The separator can directly adjoin the housing for the feed screw pairs and is preferably of cylindrical construction, for example with a diameter corresponding to the tip diameter of the feed screw pairs. The volume of the separator is then defined by an alteration of the structural length.

The invention claimed is:

1. A double-flow screw spindle machine for multiphase mixtures, comprising:

a plurality of screw spindle pairs arranged in a housing such that gaps between screw spindles, and gaps between the screw spindles and the housing, are sealable with liquid phase;

at least two separate inlet chambers to the plurality of screw spindle pairs;

an outlet chamber;

a separator situated upstream of the at least two separate inlet chambers for separating liquid phase and gas phase;

one or more first connecting lines which are configured to selectively pass the separated gas phase when the separator contains a multiphase mixture; and one or more second connecting lines which are configured to selectively pass the separated liquid phase when the separator contains a multiphase mixture, the one or more second connecting lines being separate from the one or more first connecting lines, wherein the at least two separate inlet chambers are connected to the separator by the one or more first connecting lines and, separately, by the one or more second connecting lines, and wherein the separate connection of the at least two separate inlet chambers to the separator by the one or more second connecting lines enables delivery of liquid phase that lubricates and seals at least one screw spindle pair when the separator contains a multiphase mixture.

2. The double-flow screw spindle machine according to claim 1, further comprising a switching device configured to interrupt a liquid supply to an inlet chamber of the at least two separate inlet chambers.

3. The double-flow screw spindle machine according to claim 1, wherein said one or more second connecting lines is a plurality of second connecting lines, further comprising outlets for the plurality of second connecting lines arranged at different levels in the separator.

4. The double-flow screw spindle machine according to claim 1, further comprising a switching valve disposed in or on a connecting line of the one or more second connecting lines or in or on the separator.

5. The double-flow screw spindle machine according to claim 1, wherein the separator includes a storage chamber and a surge chamber which are fluidically connected to each other.

6. The double-flow screw spindle machine according to claim 1, further comprising in the separator a splash wall having a low situated passage opening.

7. The double-flow screw spindle machine according to claim 1, further comprising a blocking device disposed in or on a connecting line of the one or more first connecting lines.

8. The double-flow screw spindle machine according to claim 1, wherein the double-flow screw spindle machine is configured as a pump.

9. The double-flow screw spindle machine according to claim 1, wherein the double-flow screw spindle machine is configured as a motor and an inlet pressure in the at least two separate inlet chambers is higher than an outlet pressure in the outlet chamber.

* * * * *